US009651255B2

(12) United States Patent
Lochschmied et al.

(10) Patent No.: US 9,651,255 B2
(45) Date of Patent: May 16, 2017

(54) CONTROL FACILITY FOR A BURNER SYSTEM

(75) Inventors: Rainer Lochschmied, Rheinstetten-Forchheim (DE); Bernd Schmiederer, Karlsruhe (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 1404 days.

(21) Appl. No.: 13/328,056

(22) Filed: Dec. 16, 2011

(65) Prior Publication Data

US 2012/0156628 A1 Jun. 21, 2012

(30) Foreign Application Priority Data

Dec. 16, 2010 (EP) ..... 101 95 526

(51) Int. Cl.
*F23N 5/00* (2006.01)
*F23N 5/12* (2006.01)

(52) U.S. Cl.
CPC ..... *F23N 5/12* (2013.01); *F23N 5/123* (2013.01)

(58) Field of Classification Search
CPC ..... F23N 1/022; F23N 5/123; F23N 5/12
USPC ..... 431/12, 18, 75, 78
See application file for complete search history.

(56) References Cited

U.S. PATENT DOCUMENTS

| | | | | |
|---|---|---|---|---|
| 5,157,920 | A * | 10/1992 | Nakaniwa | F02D 41/1441 123/691 |
| 5,924,859 | A * | 7/1999 | Nolte | F23N 1/022 431/12 |
| 7,090,486 | B2 * | 8/2006 | Lochschmied | F23N 1/022 431/12 |
| 7,628,122 | B2 | 12/2009 | Min | |
| 2008/0115773 | A1 * | 5/2008 | Gaur | F02M 23/00 123/585 |
| 2011/0018544 | A1 | 1/2011 | Bertelli | |

FOREIGN PATENT DOCUMENTS

| | | | | |
|---|---|---|---|---|
| DE | 196 27 857 | A1 | 1/1998 | |
| DE | EP 1331444 | A2 * | 7/2003 | F23N 1/022 |
| DE | 102 20 773 | A1 | 11/2003 | |
| DE | 103 19 835 | A1 | 11/2004 | |
| EP | 0 697 637 | A1 | 2/1996 | |
| EP | 0 770 824 | A2 | 5/1997 | |

(Continued)

*Primary Examiner* — Jason Lau
(74) *Attorney, Agent, or Firm* — Laurence Greenberg Werner Stemer; Ralph Locher

(57) ABSTRACT

A control facility is provided for a burner system having a burner, actuators with which the supply of fuel and air to the burner is set, and an ionization electrode arranged in the flame zone. The control facility is equipped with a flame amplifier at the ionization electrode to generate an ionization signal and a positioning facility which, in control operation, positions a first actuator and regulates a second actuator by using a corresponding target value for the ionization signal. The positioning facility carries out a control operation in a first test step, it shifts the actuators toward a supply ratio corresponding to an air coefficient above the stoichiometric value of λ=1 and in so doing captures the ionization signal in a second test step, and it calculates a target value from this and from stored data in a third test step. Correction of drift therefore takes place.

10 Claims, 3 Drawing Sheets

(56) References Cited

FOREIGN PATENT DOCUMENTS

| | | | |
|---|---|---|---|
| EP | 1 293 727 | A1 | 3/2003 |
| JP | 2004353951 | A | 12/2004 |
| JP | 2008528926 | A | 7/2008 |
| WO | 2009/110015 | A1 | 9/2009 |

* cited by examiner

CONTROL FACILITY FOR A BURNER SYSTEM

CROSS-REFERENCE TO RELATED APPLICATION

This application claims the priority, under 35 U.S.C. §119, of European application EP 101 95 526, filed Dec. 16, 2010; the prior application is herewith incorporated by reference in its entirety.

BACKGROUND OF THE INVENTION

Field of the Invention

The invention relates to a control facility for a burner system containing at least a burner, actuators with which the supply of fuel and air to the burner is set, and an ionization electrode arranged in the flame zone. The control facility is equipped with at least a flame amplifier at the ionization electrode to generate an ionization signal and a positioning facility, which, in control operation, positions a first actuator and regulates a second actuator by using a corresponding target value for the ionization signal. The positioning facility carries out a control operation in a first test step, shifts the actuators toward a changed supply ratio and in so doing captures the ionization signal in a second test step, and calculates a target value from this and from stored data in a third test step.

To enable corrections to be made for external influences affecting combustion quality, such as a change in fuel quality, temperature or fluctuations in pressure, it is possible to adjust the ratio of air to fuel, the so-called air coefficient $\lambda$. A corresponding setup is also referred to as a combined fuel/air system. An especially low-cost sensor for capturing the air coefficient is the ionization electrode. When an AC voltage is applied, an ionization current flows through the electrode and the flame, which current is adjusted to a target value predetermined as a function of the respective output of the burner. With an arrangement of this type, the air coefficient can be regulated since the ionization current is dependent on the air coefficient at the respective output point.

A control facility of the type referred to in the introduction is described in European patent EP 0 770 824 B1 (corresponding to U.S. Pat. No. 5,899,683), for example. There, the air coefficient is adjusted in such a way that it lies above the stoichiometric value of $\lambda=1$, for example at $\lambda=1.3$. For the purpose of calibrating the control target value, the maximum of the ionization current is determined at $\lambda=1$ and the next target value calculated on the basis of the maximum. During the calculation, the difference between the current ionization current value and the measured maximum is maintained. Good reproducibility of the positioning element line is not absolutely imperative in this method, although considerable CO emission occurs for a short time in the case of exceeding $\lambda=1$.

European patent EP 0 697 637 B1 shows a method for monitoring the functioning of a control or regulating system, which regularly interrupts normal operation. A fault signal is output if test values from the system sensor exceed a predetermined deviation from reference values, the deviation and reference values having been determined in a reference cycle. It is also proposed that interfering variables such as air temperature, air pressure, and air humidity are varied in this reference cycle to delimit the worthwhile operating states of the system and from this define the maximal deviations as reference values. The function monitoring does not take account, however, of creeping changes in the system within the operating range predetermined by the reference values. Similarly, a deviation beyond the operating range defined by way of the reference values, due to disturbances that falsify the test result itself, is not covered. The automatic correction of the control target value is not proposed.

In European patent EP 1 293 727 B1 (corresponding to U.S. Pat. No. 7,090,486), a calibration process is described in control operation. Proceeding on the basis of a permanently set burner output, an actuating member that influences the quantity of fuel or air supplied as a function of a actuating signal, is displaced in the direction of $\lambda=1$ by a target value specification for the ionization signal. In this respect, however, $\lambda=1$ is not exceeded. The behavior of the actuating member is observed in this respect and compared with stored values. This action is carried out one or more times and an evaluation is then made as to whether burner operation should be shut down, continued unchanged or continued with a corrected ionization target value curve. The known method requires, however, that the actuating member characteristic of the observed actuating member must be precisely reproducible and located in a narrow tolerance range.

Published, international patent disclosure WO 2009/110015 A1 (corresponding to U.S. patent publication No. 20110018544) also discloses a method during a control operation for the purpose of monitoring a flame, with the aid of which any parasitic elements occurring can be identified and compensated for. To this effect, an AC voltage source is controlled in such a way that the source delivers an AC voltage signal with a strongly differing duty factor between positive and negative amplitude with different amplitude values, which is applied to the ionization electrode. The text highlights the fact that the accuracy of a combined gas/air control system can be impaired by drift in the ionization current signal as a consequence of deposits or accretions on the ionization electrode or the burner or likewise due to bending or displacement of the ionization electrode.

SUMMARY OF THE INVENTION

It is accordingly an object of the invention to provide a control facility for a burner system which overcomes the above-mentioned disadvantages of the prior art devices of this general type, with which drift in the ionization current is corrected simply and reliably without, in so doing, exceeding predetermined limits for the combustion values.

With the foregoing and other objects in view there is provided, in accordance with the invention a control facility for a burner system. The burner system has at least a burner, first and second actuators with which a supply of fuel and air to the burner is set, and an ionization electrode disposed in a flame zone. The control facility contains at least a flame amplifier disposed at the ionization electrode for generating an ionization signal; and a positioning facility, which, in control operation, positions the first actuator and regulates the second actuator by using a corresponding target value for the ionization signal. The positioning facility carries out a control operation in a first test step, shifts the first and second actuators toward a changed supply ratio and in so doing captures the ionization signal in a second test step, and calculates a target value from this and from stored data in a third test step. In the second test step, the positioning facility shifts the first and second actuators toward a supply ratio corresponding to an air coefficient above a stoichiometric value of $\lambda=1$.

Precise modeling on the basis of empirical observations has shown that, by a test with targeted changing of the air coefficient in a region above the stoichiometric value of $\lambda=1$, and with measurement of the ionization signal, a calculation of the target value can be performed with a good level of approximation even if the change in the air coefficient is small in itself. Underlying this is also the insight that, compared with the large reductions in air coefficient in European patent EP 0 770 824 B1, hardly any temperature impulse and hardly any contamination of the burner and the ionization electrode due to pollutant emissions occurs in this way. Under certain circumstances, these would markedly exacerbate bending or accretion formation respectively, which would in turn result in drift. This insight contributes to the fact that the accuracy of the test result is unexpectedly high. Following drift in the ionization signal, the target value converges reliably on the desired value being aimed for upon repeated execution of the test, which value represents the original, correct air coefficient.

In a preferred embodiment of the invention in this respect, the air coefficient is changed to a value of $\lambda>1.05$, and preferably reduced by a value of $\Delta\lambda<-0.06$. It has in fact been shown, on the one hand, that in this air coefficient range, the ionization signal measurement is sufficient over and above the signal noise, in the case of a low level of drift, to calculate the target value precisely. On the other hand, the lower limit of the air coefficient range can be reliably maintained even in the case of a great deal of drift since drift only takes place as a creeping phenomenon and the test is repeated regularly, preferably after 3,000 burner operating hours at the latest.

In a preferred embodiment of the invention, the position of one actuator, preferably that for the fuel supply, is maintained and that of the other actuator changed during the execution of the test. Due to the fact that the position of one of the actuators is maintained, the test result is no longer dependent on its manufacturing tolerances.

In a further preferred embodiment, the stored target value characteristic for the ionization signal is then replaced on the basis of the calculated target value and stored data. Optionally, in the case of an extreme change to the target value characteristic, a warning message or a fault-condition shutdown can be triggered and in particular the actuator for the supply of fuel can be closed.

Other features which are considered as characteristic for the invention are set forth in the appended claims.

Although the invention is illustrated and described herein as embodied in a control facility for a burner system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
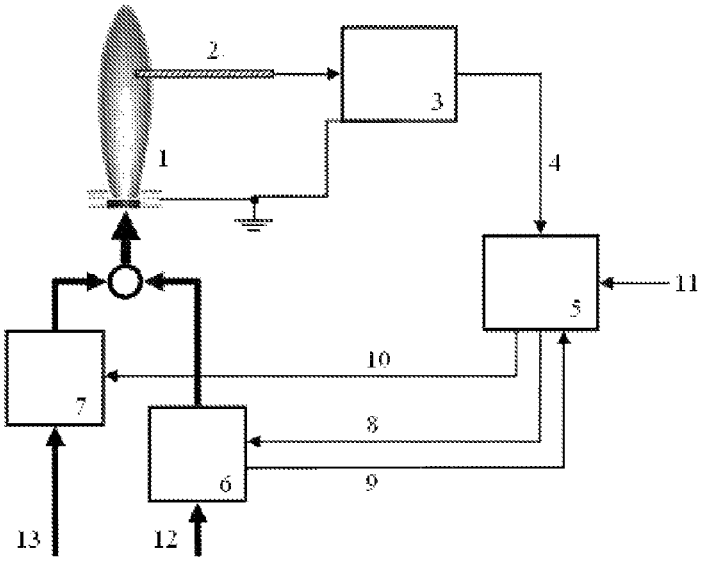
FIG. 1 is a schematic representation of a burner system with a control facility, which is regulated with the aid of an ionization signal according to the invention.

Referring now to the figures of the drawing in detail and first, particularly, to FIG. 1 thereof, there is shown a schematic representation of a burner system with an inventive control facility, which functions as a combined fuel/air control system in normal operation. An ionization current through a flame 1 generated by a burner is captured, via an ionization electrode 2, by a flame amplifier 3. The circuit is completed by the connection of the flame amplifier 3 to the burner ground. The ionization signal 4 processed by the flame amplifier 3 is forwarded to a positioning facility 5, which uses the ionization signal 4 as an input signal for a control system in normal operation. The ionization signal 4 is configured as an analog electrical signal, but alternatively it can be implemented as a digital signal or a variable of two software module units.

The positioning facility 5 receives an external request signal 11, with which the thermal output is specified. Additionally, the control system can be switched on and off with the request signal 11. For example, a heat request is generated by a superordinate temperature control loop, which is not shown here. An output specification of this type can naturally be generated by some other external consumer or likewise direct by hand, for example specified by way of a potentiometer.

As is customary, the request signal 11 is mapped to one of the two actuators 6, 7 with the aid of data deposited in the positioning facility 5. In the preferred manner, the request signal 11 is mapped to speed target values for a blower as the first actuator 6. The speed target values are compared with a speed signal 9 fed back by a blower 6. With the aid of a speed controller integrated in to the positioning facility 5, the blower 6 is shifted via a first positioning signal 8 to the target delivery rate for the air 12 for the specified request signal 11. Naturally, the request signal 11 can be mapped direct to the first positioning signal 8 for the blower 6 as an alternative. Conversely, mapping of the request signal 11 to a fuel valve as the first, performing actuator 6 is likewise possible.

With the second actuator 7, in the preferred manner a fuel valve, the air coefficient is tracked via the supply of fuel 13. This is affected in that the specified request signal 11 is mapped via a function to an ionization target value in the positioning facility 5. This target value is compared with the ionization signal 4. With the aid of the control deviation, the fuel valve 7 tracking the air coefficient is regulated via a control unit implemented in the positioning facility 5. A change in the ionization signal 4 therefore brings about, via a second positioning signal 10, a change in the position of the fuel valve 7 and hence the throughput of the quantity of fuel 13. The control loop is closed in that in the case of the specified air quantity, a change in the quantity of fuel brings about a change in the ionization current through the flame 1 and the ionization electrode 2, and as a result also a change in the ionization signal 4, until its actual value is once again the same as the specified target value.

Figure 2:
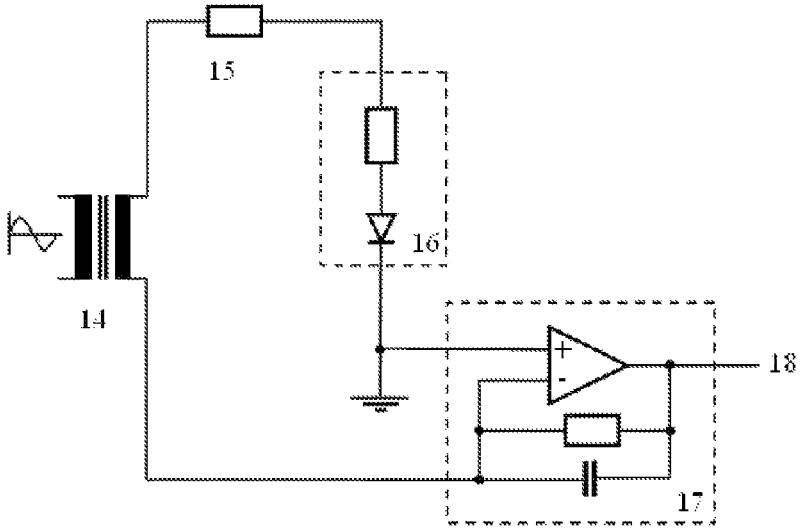
FIG. 2 is an electrical circuit diagram of a flame amplifier in the control facility according to FIG. 1 for an ionization current measurement.

FIG. 2 shows an electrical circuit diagram of the flame amplifier 3 for an ionization current measurement. It is executed in accordance with FIG. 3A in published, European patent application EP 2 154 430 A1. In this respect, an AC voltage is applied to the ionization electrode. Due to the rectifying effect of the flame, an ionization current only flows in one direction through the flame. The size of the ionization current is dependent on the flame resistance of the flame in this respect, and forms a measure for the air coefficient.

The circuit is constructed out of an AC voltage source 14, a current-limiting resistance 15, the electrical equivalent for the flame 1 and the ionization electrode 2—represented as a flame equivalent circuit 16—and a linear amplifier 17, at the output 18 of which the ionization signal 4 is fed out. The output 18 delivers the ionization signal 4 directly. Alternatively, however, circuit elements can also be connected between the output 18 and the positioning facility 5 for the purpose of galvanic decoupling. In this circuit example, the AC voltage source 14 is implemented by a transformer, to which an input AC voltage is applied.

Figure 3:
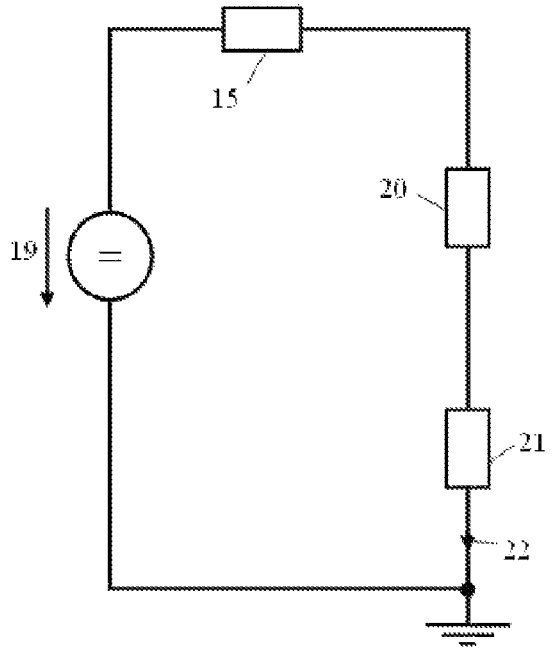
FIG. 3 is an electrical dc current equivalent circuit diagram derived from the circuit diagram according to FIG. 2 for an ionization current measurement.

The amplifier 17 measures the ionization current through the flame equivalent circuit 16, the connection to the AC voltage source 14 being led to virtual ground. The amplifier 17 averages the ionization current and decouples the output 18 from the actual ionization circuit. The averaged ionization current can be calculated direct from the voltage at the output 18 and the negative-feedback resistance of the amplifier 17. The averaged ionization current corresponds to a quasi-stationary dc current value. 'Quasi-stationary' means here that time function elements in the circuit and pure AC voltage signals caused by the AC voltage source 14 do not play a part at the output 18. The signal at the output 18 consequently just follows the considerably slower changes in the resistance in the flame equivalent circuit 16. With regard to the averaged ionization current, therefore, a simpler abstract equivalent circuit diagram can be obtained, which is represented in FIG. 3.

A dc voltage source 19 generates, by means of its dc voltage U, a dc current 22 through the current-limiting resistance 15, a flame resistance 20, and a fault resistance 21.

The resistance in the electrical equivalent of the flame equivalent circuit 16 can be regarded as the resultant resistance from two resistors connected in series, that is to say the actual flame resistance 20 during normal operation as prescribed and a fault resistance 21, which is caused by the aforesaid accretions on the ionization electrode 2 or the burner. The accretions arise due to deposits on the ionization electrode or the burner, caused in particular by oxidation processes, soot formation in the case of dirty oil combustion or due to the introduction of dust via the supply of air. Strongly isolating accretions can arise in this respect, which change the amount of the quasi-stationary dc current 22 via a rise in the fault resistance 21.

A model is described below with the aid of which it has been shown that small changes in air coefficient are sufficient for the test, and can even deliver better results, in order to reliably recalculate and correct the target values. As a result, the air coefficient can be held to its goal value.

Bending or displacement respectively of the ionization electrode 2 is likewise largely taken into account by the fault resistance 21 in the equivalent circuit diagram in FIG. 3, wherein the fault resistance 21 could then also be given a negative value.

Furthermore, parasitic conductive paths, which are not shown, in the zone of the flame 1 parallel to the actual flame equivalent circuit 16 can also be included. In the case of the constant presence of such a path, the path can be included or its effect taken into account via the flame resistance 20; in the case of a parasitic path varying over time, this can be done via the fault resistance 21.

The dc voltage U of the dc voltage source 19 is produced by the time duration for which a current caused by the AC voltage source 14 in FIG. 2 flows effectively through the flame 1, that is to say through the flame equivalent circuit 16. It is calculated as an average value of the voltage average value over the conducting half-wave and the voltage value equal to 0 over the blocked half-wave. In the case of the sinusoidal AC voltage of the AC voltage source 14 with an amplitude $U_1$, the dc voltage of the dc voltage source 19 is $U=U_1/\pi$.

The dc current 22 can be determined direct from the voltage at the output 18 and the negative-feedback resistance of the amplifier 17. It is available as the ionization signal 4 at the input of the downstream positioning facility 5.

The abstract equivalent circuit diagram in FIG. 3 is naturally not only applicable to the circuit in FIG. 2. In principle, the equivalent circuit diagram can be used for many systems for flame signal capture, the output signal of which for the positioning facility 5 can be assigned to a quasi-stationary dc current 22, which is caused by the change in the flame resistance.

In this respect, a dc current is generated in the electrical circuit for flame signal capture, which can be mapped to the quasi-stationary dc current 22 of the circuit according to FIG. 3. The real flame resistance is mapped to the flame resistance 20 of the equivalent circuit diagram according to FIG. 3, wherein other circuit elements, for example measurement resistances, are also included in the value of the flame resistance 20. The fault resistance 21, the current-limiting resistance 15, and the dc voltage source 19 can, in the same way, be understood as the result of a mapping from another circuit.

Figure 4:
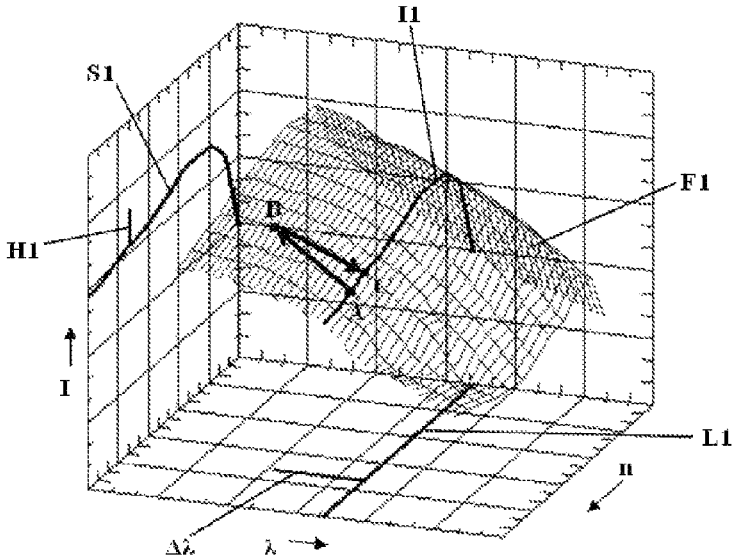
FIG. 4 is an illustration showing simulated ionization current values at the output of the flame amplifier in the control facility according to FIG. 1 as a function of blower speed n and an air coefficient $\lambda$ without fault resistance.

FIG. 4 shows, in a three-dimensional illustration, simulated ionization current values I at the output 18 of the flame amplifier 3 as a function of the blower speed n and the air coefficient λ. A curve 11 for the ionization current is represented on a surface F1 defined by the blower speed and the air coefficient. By means of a stored target value characteristic S1, the ionization current can be regulated to the specified target value for any blower speed n. In the case of an assumed constant air coefficient and variable blower speed n corresponding to the air coefficient curve L1 in the n/λ plane across the burner-specific surface F1, the course of the ionization current curve I1 on the surface F1, and as a result the target value characteristic S1 in the n/I plane, are then obtained. The relationships shown in FIG. 4 apply on condition that no drift occurs in the ionization current and therefore no fault resistance 21. In this case, it is possible, with the aid of a reference measuring section qualified as good, to calculate the sum of the current-limiting resistance 15 and the flame resistance 20 from the known dc voltage U of the dc voltage source 19 and the value of the measured or determined dc current 22.

Figure 5:
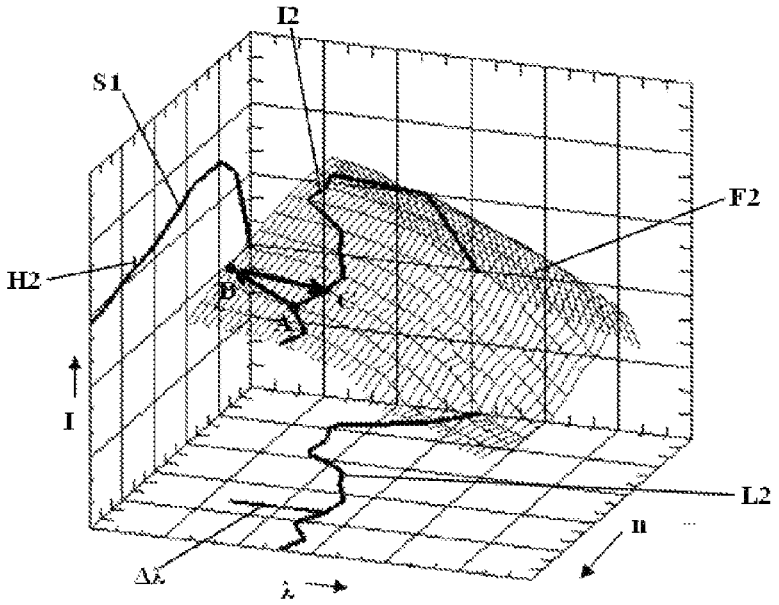
FIG. 5 is an illustration showing simulated ionization current values at the output of the flame amplifier in the control facility according to FIG. 1 as a function of the blower speed n and the air coefficient $\lambda$ with a fault resistance.

If drift does occur in the ionization current and consequently a fault resistance 21, the relationships represented in FIG. 5 are produced, wherein the surface F2 is displaced downward with approximately the same shape in the example shown as compared with the surface F1 shown in FIG. 4.

Due to the drift, therefore, a different ionization current curve 12 is obtained for the ionization current target values in the presence of the same target value characteristic S1, and as a result a different air coefficient curve L2 in the n/λ plane, according to which the air coefficient no longer holds its desired, constant value at all at various blower speeds and therefore at various burner outputs.

A test process is used for the purpose of detecting drift. To this effect, the combined fuel/air control system is set to a preferred fixed start point A. In this regard, the blower speed n and the resultant volumetric flow of air move to the stored value for the start point A. The second positioning signal 10 relating to the fuel valve 7, and as a result the volumetric flow of fuel, are tracked in the closed control loop. The air coefficient ends up at its value as specified in accordance with the target value characteristic S1 again and corresponds to the desired value if no drift is present. In the preferred manner, the position of the fuel valve is determined in a time window by the taking of an average value.

As the second step in the test, a movement is effected from the regulated, stable status of the start point A to the test point B in that the speed n of the air blower is reduced by a stored value, with the position of the fuel valve 7 being kept constant. In the process, the air coefficient is lowered by a more or less constant change in the air coefficient Δλ. Then the ionization current is measured inside a time window by the taking of an average value.

In the third test step explained in the following, the target value for the ionization current is calculated anew at a comparison point C with the aid of the measured value at the test point B.

In an alternative method, a transition takes place from the test point B to the comparison point C in the presence of the previously existing target value, at which point the blower speed of the air blower remains unchanged but the fuel valve is re-adjusted to the specified air coefficient according to the ionization current curve I1. The fuel valve is preferably shifted to a stored value prior to the release of the control system, which value already corresponds to the position to be expected. The change in the air coefficient Δλ between the points B and C is, as represented in FIGS. 4 and 5, almost equally large with and without fault resistance 21. With the previous target value, however, the ionization current swing H2 in FIG. 5 would be, due to the fault resistance 21, markedly smaller than the corresponding ionization current swing H1 in FIG. 4. The ionization current swing H2 in response to the change in air coefficient Δλ therefore reveals a control operation to a changed air coefficient. With the aid of the measured ionization current swing H2, an improved target value can be calculated and the air coefficient corrected.

Finally, the drift test ends in that normal operation with control according to the request signal 11 is restored.

The drift test can be carried out at one or more test points. In the case of more than one test point, any dependency of the fault resistance 21 on the burner output can be detected and taken into account correspondingly in the case of a correction.

In a setting process for the relevant burner type, the test point B is preferably selected in such a way that the ionization current value is stable there, including in the case of a large difference between the gradients at the test point B and the comparison point C on a function I=f(λ) in the case of the selected blower speed n. As a result, a large signal-to-noise ratio is achieved. Under these conditions, the test point B can be selected in a wide range along the function I=f(λ). The shape and profile of the function remain unknown in this respect. The only pre-condition is that the function is uniformly rising or falling in the measurement range of the test point B. By means of the calculation method for the target value correction described in the following, it has been shown that in the case of a change in air coefficient to λ>1.05, these conditions are typically in effect. By way of advantage, the air coefficient is reduced in this respect by at least Δλ<−0.06 from its adjusted status. For a specific burner type, for which the air coefficient was set to λ=1.3, an optimal change in air coefficient of Δλ=−0.15 was identified. Alternatively, the air coefficient is raised by at least Δλ=+0.08. Selection of this alternative is likewise worthwhile in the case of burners with correspondingly different gradient profiles at point B to point C with very good convergence and a small quantity of iteration steps. In the case of an excessively large change in air coefficient, for example by Δλ>+0.5, there is a danger of the combustion resulting in pollutant emissions because of the lower flame temperature, or even of the flame 1 being extinguished.

The start point A represented in FIG. 4 is produced direct from the set test point B, by changing the air coefficient by Δλ via the air quantity.

The blower speeds n at the points A and B were stored as specification values in the control facility prior to normal operation. Preferably, the ionization current value at the test point B was averaged over a plurality of measurements on a system without fault resistance 21 and stored in the positioning facility 5 for the purpose of calculating the correction values.

The comparison point C is produced by the selection of the test point B with the blower speed of the test point B on the ionization current curve I1.

With regard to the calculation of the new target value for the purpose of drift correction in the third test step, use is made of the fact that the blower speed is changed in such a way independently of the fault resistance 21 that the air coefficient is changed by an almost constant Δλ. Due to the small change in ionization current in the zone of the test point B, the flame resistance 20 there can be assumed to be constant in an initial approximation. Given the assumption of the same fault resistances 21 at the test point B and at the comparison point C, a corrected target value can be calculated by using the ionization current value determined without fault resistance 21. Additionally, the fault resistance 21 can also be determined.

By means of iterative execution of the aforesaid test with recalculation of the target value at the comparison point C, there is rapid convergence on a target value at the comparison point C, which no longer changes during further iterations with no change in the fault resistance 21.

Figure 6:
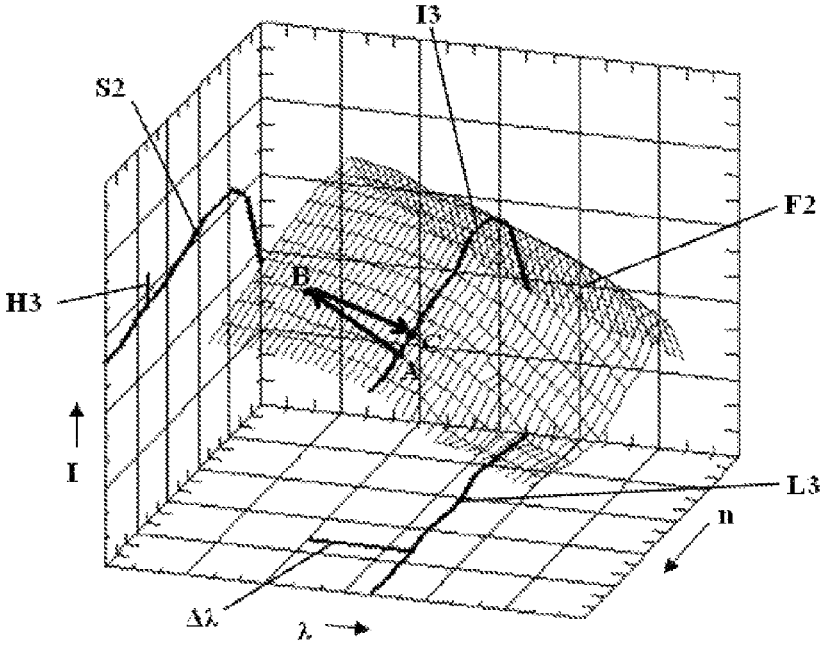
FIG. 6 is an illustration showing simulated ionization current values at the output of the flame amplifier in the control facility according to FIG. 1 as a function of the blower speed n and the air coefficient $\lambda$ with a fault resistance but after going through a correction loop.

FIG. 6 shows the lines S2, I3, L3 obtained after a first test, wherein the fault resistance 21 at the test point B and at the comparison point C was assumed to be the same. A corrected target value characteristic S2 can be calculated with the fault resistance 21 known from the aforesaid calculations and a stored target value characteristic S1. The ionization current curve 13 is represented on the surface F2 of FIG. 6. The air coefficient curve L3 in the n/λ plane following the first test already corresponds relatively closely to the air coefficient curve L1 shown in FIG. 4. The ionization current swing H3 rises to a constant value not equal to H1. Following one or two iterations, there is practically no deviation present any more between L3 and L1.

If the fault resistances 21 differ significantly at the comparison point C and the test point B, then this must also be taken into account in the correction calculation for the target value. This can be done in the form of a correction factor K that expresses the ratio between the fault resistance 21 at the comparison point C and the test point B. The correction factor K, as the ratio between the fault resistance 21 at the comparison point C and the fault resistance 21 at the test point B is dependent on the composition of the accretion layer and lies as a rule between 1 and 2.

The fault resistances 21 at the comparison point C are then determined from the fault resistance 21 at the test point B and the correction factor K, and the new target value characteristic S2 can be obtained at any point on the target value characteristic S1 as follows.

At the test point B, the fault resistance 21 is calculated from the measured ionization current and its stored value from an identical burner system without fault resistance. By using the given target value characteristic S1, the new target value at the comparison point C and every further point on the new target value characteristic S2 is calculated. In the case of a plurality of test points B, the new target value at the comparison point C is calculated at every test point, and also the other target value characteristic points determined from the given target value characteristic S1 and the average value of the two correction values weighted by way of the blower speed spacing. Naturally, other calculation methods can also be used.

Normally, in the case of an extremely large drop in a corrected target value characteristic S2 compared with the original target value characteristic S1, the system shuts down in normal operation since the flame resistance 20 can then no longer be sufficiently resolved compared with the fault resistance 21, and positive feedback takes place. Optionally, a warning indication or a fault-condition shutdown can already be generated in the case of such a large deviation between these target value characteristics in themselves.

The ionization current values at the points B and C were determined in advance in a setting process for such a burner system without fault resistance 21. In this respect, a target value characteristic S1 with the specified air coefficient for a prototype was created with the aid of sensors, with which the air coefficient can be measured in a direct or indirect manner. As a result, the target value $I_{C0}$ for the ionization current at the comparison point C is known. Additionally, the test point B was set on the prototype and the associated ionization current $I_{B0}$ measured. $I_{B0}$ and the values of the target value characteristic S1 including $I_{C0}$ were stored for further processing at a subsequent point in operation in the positioning facility 5.

In operation, during the successive tests, the ionization current value $I_{B1}$, and subsequently $I_{B2} \ldots I_{Bn}$, is captured at the test point B, which value may possibly deviate from $I_{B0}$ due to drift occurring in the meantime. The captured ionization current values can be averaged over a plurality of tests to reduce scatter. Correction of $I_{B0}$ is then effected with the aid of the averaged measured values.

If a fault resistance 21 then occurs during normal operation, the resistance being able to assume not only positive values but also as a matter of principle negative values, then the measured ionization current value $I_{B1}$ changes both on the basis of the changed air coefficient value and also on the basis of the fault resistance 21, the resistance bringing about a projection of the surface F1 to the surface F2, as shown in FIGS. 4 and 5.

Due to the small gradient of the function I=f(λ) at the test point B compared with the gradient at the comparison point C, the flame resistance 20 at the test point B changes less than that at the comparison point C. Consequently, as an initial approximation, the flame resistance 20 at the test point B can be assumed to be the same with and without fault resistance. In accordance with the equivalent circuit diagram according to FIG. 3, the corrected ionization current target value at the comparison point C, which in control operation following the test is equal to the ionization current $I_{C1}$ there, can be calculated as $$\frac{1}{I_{C1}} = \frac{1}{I_{B1}} - \frac{1}{I_{B0}} + \frac{1}{I_{C0}}$$

if the fault resistances 21 at the test point B and the comparison point C are assumed to be the same. In the test, the positioning facility 5 calculates new target values in accordance with this formula. By way of advantage, it is permanently specified to this effect in a program run on a microprocessor. For the next iteration of the correction, the test point B already lies closer to the goal value, so that the flame resistance 20 with and without fault resistance 21 is approximated even better and the target value is produced as $$\frac{1}{I_{C2}} = \frac{1}{I_{B2}} - \frac{1}{I_{B0}} + \frac{1}{I_{C0}}.$$

If the fault resistance remains the same, the new target value current converts with the k-th iteration via $$\frac{1}{I_{Ck}} = \frac{1}{I_{Bk}} - \frac{1}{I_{B0}} + \frac{1}{I_{C0}}$$

to a constant value.

This can be carried out in an equivalent manner for every point on the target value characteristic S1, by replacing the current value $I_{C0}$ by the current $I_{n0}$=f(n) of the target value characteristic S1 and obtaining the value $I_{nk}$ after the k-th iteration by means of $$\frac{1}{I_{nk}} = \frac{1}{I_{Bk}} - \frac{1}{I_{B0}} + \frac{1}{I_{n0}}.$$

The values of $I_{nk}$ produce the values of the target value characteristic S2 after the k-th iteration. In conformity with FIG. 6, quite good correction values for the target value characteristic S2 are already obtained after the first test. After the first and second iteration, the end value is already reached in practical terms.

If the fault resistance 21 at the points B and C cannot be regarded as the same due to the nature of the accretion, then the formulae shown above can be adapted by the factor K between the fault resistances $$\frac{1}{I_{nk}} = K \cdot \left(\frac{1}{I_{Bk}} - \frac{1}{I_{B0}}\right) + \frac{1}{I_{n0}}.$$

The factor K is dependent on the nature of the accretion and can be determined experimentally in the setting process.

If the test is performed at two or more points, for example at high output and low output, then the various values of the fault resistances 21 can be weighted in relation to the blower speed or some other available output value for the purpose of determining the corrected target value characteristic S2.

The invention claimed is:

1. A control facility for a burner system, the burner system having at least a burner, first and second actuators with which a supply of fuel and air to the burner is set, and an ionization electrode disposed in a flame zone, the control facility comprising:

at least a flame amplifier disposed at the ionization electrode for generating an ionization signal;

a positioning facility, which, in control operation, positions the first actuator and regulates the second actuator by using a corresponding target value for the ionization signal, said positioning facility carrying out the control operation in a first test step, shifts the first and second actuators toward a changed supply ratio and in so doing captures the ionization signal in a second test step, and calculates a target value from the ionization signal and from stored data in a third test step, in the second test step, said positioning facility shifting the first and second actuators toward a supply ratio corresponding to an air coefficient above a stoichiometric value of $\lambda=1$, an inverse of the target value is a first order polynomial development of an inverse of the ionization signal and of an inverse of the stored data; and wherein the stored data is a function of at least another ionization signal.

2. The control facility according to claim 1, wherein in the second test step, said positioning facility changes the air coefficient to a value of $\lambda>1.05$.

3. The control facility according to claim 1, wherein in the second test step, said positioning facility reduces the air coefficient by a value of $\Delta\lambda<-0.06$ to $\lambda>1.05$.

4. The control facility according to claim 1, wherein said positioning facility repeats a test after 3,000 operating hours at a latest.

5. The control facility according to claim 1, wherein in the second test step, said positioning facility maintains a position of one of the first and second actuators and changes that of the other of the first and second actuators.

6. The control facility according to claim 1, wherein in the second test step, said positioning facility maintains a position of the second actuator for the supply of the fuel and changes that of the first actuator for the supply of the air.

7. The control facility according to claim 1, wherein said positioning facility repeats the first, second, and third test steps in a presence of a different supply of the air or the fuel.

8. The control facility according to claim 1, wherein in a fourth test step, said positioning facility replaces a stored target value characteristic for the ionization signal on a basis of at least one calculated target value and the stored data.

9. The control facility according to claim 1, wherein in a fourth test step, said positioning facility effects a fault-condition shut-down and closes the second actuator for the supply of the fuel on a basis of a deviation between the stored data and a target value calculated from the ionization signal and from the stored data.

10. The control facility according to claim 8, wherein the stored data contain at least part of the stored target value characteristic for the ionization signal as captured in a setting process.

* * * * *